US006244261B1

(12) United States Patent
West, Jr.

(10) Patent No.: US 6,244,261 B1
(45) Date of Patent: Jun. 12, 2001

(54) LINE INSTALLATION TOOL

(76) Inventor: David A. West, Jr., 8114 Ingberg Trail, Cottage Grove, MN (US) 55016

( * ) Notice: Subject to any disclaimer, the term of this patent is extended or adjusted under 35 U.S.C. 154(b) by 0 days.

(21) Appl. No.: 09/316,743

(22) Filed: May 21, 1999

(51) Int. Cl.[7] ..... F41B 11/06; F42B 12/68

(52) U.S. Cl. ..... 124/60; 124/74; 124/27; 89/1.34; 102/504; 441/5; 43/6

(58) Field of Search ..... 124/70, 71, 73, 124/74–56, 61, 26, 27, 60; 89/1.34; 441/85, 84; 43/19, 6; 102/504; 42/103

(56) References Cited

U.S. PATENT DOCUMENTS

| | | | | |
|---|---|---|---|---|
| 305,873 | * | 9/1884 | Williams | 42/51 |
| 394,926 | * | 12/1888 | Ingersoll | 102/504 |
| 1,020,366 | * | 3/1912 | Olsen | 89/1.34 |
| 1,418,964 | * | 6/1922 | Norman | 89/1.34 |
| 2,069,276 | * | 2/1937 | Ryan | 102/504 |
| 2,111,374 | * | 3/1938 | Sedgley | 42/106 |
| 2,388,749 | * | 11/1945 | La Pierre | 242/129.5 |
| 3,045,659 | * | 7/1962 | Malcolm | 124/57 |
| 3,056,395 | * | 10/1962 | Merz et al. | 124/57 |
| 3,382,859 | * | 5/1968 | Myers | 124/74 |
| 3,505,926 | * | 4/1970 | Johnson | 89/1.34 |
| 3,583,087 | * | 6/1971 | Huebner | 42/105 |
| 3,583,381 | * | 6/1971 | Eaton et al. | 124/73 |
| 3,669,087 | * | 6/1972 | Hamrick et al. | 124/74 |
| 4,056,859 | * | 11/1977 | Pace | 7/107 |
| 4,077,349 | | 3/1978 | Paul . | |
| 4,505,179 | * | 3/1985 | Nelson et al. | 89/16 |
| 4,741,243 | | 5/1988 | Snider . | |
| 4,784,035 | | 11/1988 | Fishfader et al. . | |
| 4,799,906 | | 1/1989 | Perkins, Jr. . | |
| 5,060,413 | | 10/1991 | Garcia . | |
| 5,121,901 | | 6/1992 | Cassidy et al. . | |
| 5,228,690 | * | 7/1993 | Rudell et al. | 473/573 |
| 5,374,034 | | 12/1994 | Flores, Sr. et al. . | |
| 5,398,587 | | 3/1995 | Kornblith . | |
| 5,450,839 | * | 9/1995 | Nicolaevich et al. | 124/73 |
| 5,784,823 | * | 7/1998 | Chen | 42/103 |

* cited by examiner

*Primary Examiner*—Peter M. Poon
*Assistant Examiner*—James S. Bergin
(74) *Attorney, Agent, or Firm*—Nikolai, Mesereau & Dietz, P.A.

(57) ABSTRACT

A hand-held apparatus for projecting a line across an intermediate span includes a launching tube having one end connected to a source of propellant gas energy for launching a projectile, the other end forming an open muzzle adapted to receive and fire a line deploying projectile. The projectile is releasably attached to one end of the line attached to a source of line connected to the launch tube and containing a supply of line to be payed out during the flight of the projectile. An axially-mounted laser sighting device connected to the launch tube for sighting the tube in on a remote target for the projectile is also provided.

17 Claims, 4 Drawing Sheets

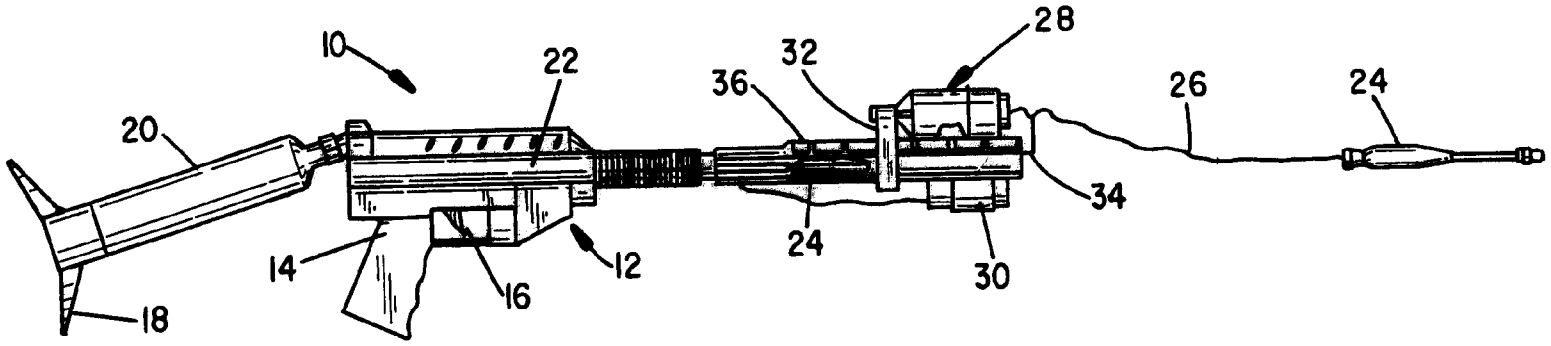
FIG. 1
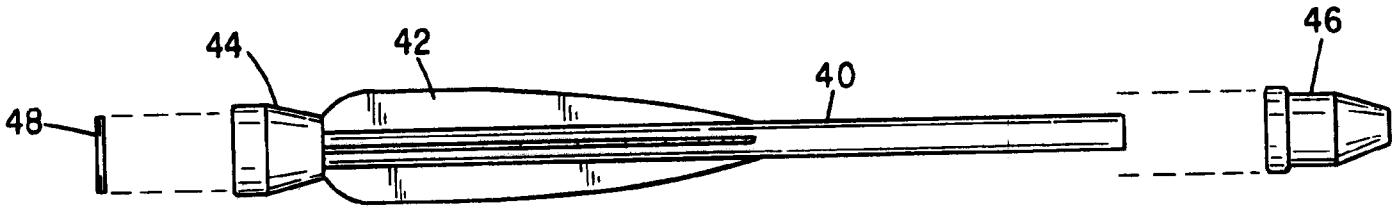
FIG. 2a
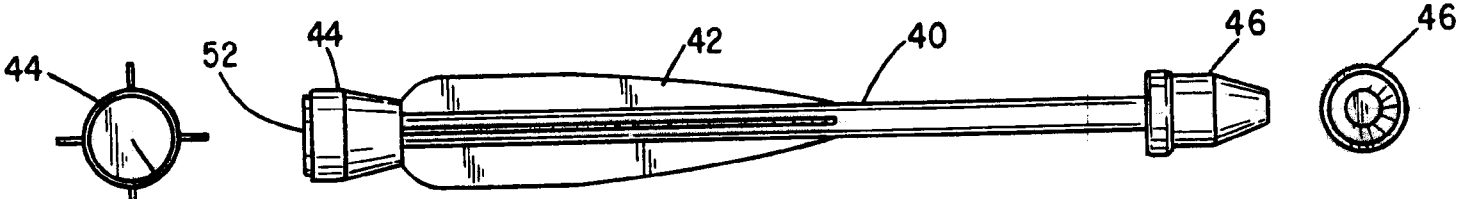
FIG. 2c
FIG. 2e
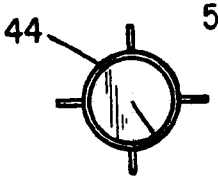
FIG. 2b

LINE INSTALLATION TOOL

BACKGROUND OF THE INVENTION

I. Field of the Invention

The present invention is generally directed to devices for directing a pilot or guide line across a span, particularly one of limited or partially obstructed access, in the anticipation of drawing or fishing a conductor or cable of desired type across the span using the guide line. The invention more particularly is directed to a line shooting tool that accomplishes the placement of such a line using an accurate lightweight projectile firing device provided with aiming and line dispensing systems that cooperate to accurately propel a harmless missile with releasably attached guide line to span a limited access region such as a space above a suspended ceiling which may require aiming to avoid obstructing devices.

II. Related Art

The stringing of wires, cables and the like across spans of limited or partially obstructed accesses such as areas of above suspended ceiling systems has long been a time-consuming and tedious task. This is particularly true in commercial settings where a maze of conductors is required to service integrated computer and telephone networks in addition to the provision of electrical wiring and other conduits in a typical office setup. A great deal of time and effort is dedicated to stringing several types of conductors across expanses of ceiling space which typically is accomplished by a worker removing suspended ceiling panels while standing on a ladder and advancing the lines a few panels at a time, moving the ladder and repeating the process.

Historically, instruments have been devised to propel missiles carrying trailing lines for a variety of diverse primary purposes under different circumstances. The patent art is replete with examples of this. Flores, Sr. et al in U.S. Pat. No. 5,374,034 disclose a line installing apparatus for firing a line through existing conduits using a rubberized line carrying plug and a light line connected to a supply spool integral with the device. The system is attached to a source of high pressure compressed gas which is used to pressurize the conduit behind the line carrier; so that device is limited to threading a line, through an existing conduit or tube. Cassidy et al (U.S. Pat. No. 5,121,901) involves a device for the installation of fiber optic transmission lines, but is also limited to existing fixed tubular paths. U.S. Pat. No. 5,060,413 to Garcia discloses a cartridge firing apparatus for launching a fishing line sinker which, in turn, drags the fishing line to distances that exceed those reachable by normal hand casting. Kornblith in U.S. Pat. No. 5,398,587 discloses a gas propelled line deployment system that includes a cartridge launched from a marine flare pistol of a conventional design as by using a blank cartridge. Another blank round missile-firing, line-launching device is depicted in U.S. Pat. No. 4,799,906 to Perkins, Jr.

Thus, while devices exist characterized by the ability to propel a lead line for stringing a conductor or even propelling a fishing line to distances greater than those normally accessible by hand exist, there clearly remains a need for an accurately aimable system to facilitate the stringing of lines and cables, or the like, in cluttered yet undefined spaces such as those above suspended ceiling panels. Accordingly, a relatively lightweight, hand-held delivery system for placing a lead or pilot line across a ceiling, or the like, capable of being precisely aimed in order to avoid a variety of intermediate obstacles would be widely sought.

It is therefore an object of the present invention to provide a hand-operated line placing apparatus capable of projecting a lead or pilot line through a confined, cluttered, possibly partially obstructed space, for attachment of lines or cables to be installed across the space.

Another object of the present invention is to provide a hand-operated, line-shooting apparatus capable of being precisely aimed to a target sited across a space to be spanned.

Yet another object of the present invention is to provide a hand-operated, line-shooting apparatus utilizing a laser sighting device.

Yet still another object of the present invention is to provide a hand-operated line-launching apparatus in which the line is releasably attached to a harmless, tube-launched missile.

A further object of the invention is to provide a hand-operated line launching device that projects a lead or pilot line across a space, the line being releasably attached by a hook and loop system to a missile attached to a low-friction line payout system.

A still further object of the present invention is to provide a hand-operated line launching or shooting device that uses a relatively harmless propellant system.

Other objects and advantages of the invention will become apparent to those skilled in the art upon familiarization with the specification, drawings and claims contained herein.

SUMMARY OF THE INVENTION

By means of the present invention, much of the tedium of moving ladders and ceiling panels to thread conductors, cables, flexible conduit, or the like, across expanses of dropped ceiling spaces or other gaps is alleviated. The invention provides an accurate pilot or lead line dispensing device or tool capable of spanning as much as several hundred feet of space utilizing a harmless gas-propelled, tube-launched missile carrying a releasably attached filament line dispensed or payed out from a source integral with the launching tool.

The device of the detailed embodiment is gas fired and includes a hand-held launch tube or elongated gun barrel with attached source of pressurized propellant gas and a sighting device which projects a visible image on a target area. This is preferably an aiming system employing a laser such as an axially oriented, battery-operated, laser sight. The pilot or lead line is placed using a reusable missile or dart adapted to be muzzle loaded into the gun or launch tube and having the line attached thereto. The line is preferrably a strong, lightweight filament guide or pilot line fed continuously from a payout source such as an enclosed, low friction spool for low drag line dispensing. The launch tube or gun may be of the conventional gas fired type used to propel harmless projectiles using compressed $CO_2$ or the like. Spring operated systems or ones using blank cartridges, however, are also well known and could also be employed to provide the launching energy. The tool is preferably activated using a conventional finger-operated guarded trigger assembly. The laser sighting device may also be of conventional design of a class which can be obtained commercially and attached in a known manner.

The sighting device and the spool assembly may be attached to the launch tube or gun barrel using a two-piece bracket which captures the barrel and mounts these devices in a "over and under" configuration. Multiple spools with darts and attached light filament line sources may be mounted to the tube in other contemplated embodiments.

The missile or projectile is preferably of a soft, rubbery nosed dart-like design with conventional guidance fins and a blunt aft section. The lead line or pilot line is preferably attached to the aft area of the missile and may be captured using a hook and loop or VELCRO™ type fastening system for easy removal and attachment of the conductor, etc., to be installed. The line itself may be any lightweight mono- or multi-filament line, possibly nylon, polyester or other relatively strong material.

In operation, the device is typically deployed from a step ladder which elevates the operator to a position where the device may be aimed, for example, above an installed dropped ceiling through a removed suspended ceiling panel or the like. The operator selects a remote target in the vicinity of the source of the conductor, etc., to be installed or fished through (as a spot on a far wall or other selected remote target) and fires a projectile to that end. The fired projectile is then retrieved through a second removed panel, the lead line detached from the projectile and the cable or other conductor attached to the line and fished back through to the origin.

BRIEF DESCRIPTION OF THE DRAWINGS

In the drawings wherein like numerals are utilized to designate like parts throughout the same:

FIG. 1 is a side view depicting a line-shooting tool apparatus for installing a lead or guide line in accordance with the invention, including depicting both a loaded (phantom) and a fired projectile;

FIGS. 2*a*–2*e* depict details of a typical missile or line-carrying dart in accordance with the invention;

DETAILED DESCRIPTION

Figure 3C:
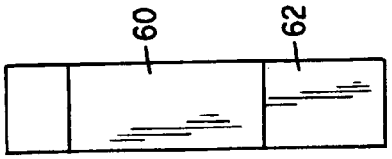
FIGS. 3*a*–3*c* depict a bracket assembly for mounting on the barrel or launch tube of the invention.

It will be appreciated that the detailed embodiment described in regard to the present invention is meant to be exemplary of that invention and not limiting in any manner. Thus, while the descriptions and accounts may relate to specific items, it should be kept in mind that variations that would occur to those skilled in the art are also contemplated here. Thus, for example, while the tool may be depicted as muzzle loader and as gas or $CO_2$ operated, a breach loaded launching barrel may be used and other propellant devices such as compression springs or blank cartridges may be employed to launch the projectile.

FIG. 1 depicts a view of a muzzle loading version of a line launching tool in accordance with the invention shown generally at 10, including a launching tube or gun barrel 12, having a handgrip 14 and trigger and trigger guard assembly 16. A shoulder addressing butt plate as at 18 may be attached to a supply of pressurized gas at 20, which may be $CO_2$, and which is attached to supply compressed gas to a tube or barrel 22 in a well known and conventional manner. A line carrying projectile 24 is shown in both the launched and pre-launch (phantom) positions with lead or guide line 26 attached. A source of the line is shown at 28 and a battery-operated laser sight is shown at 30. The line dispenser 28 and sight 30 are further carried stabilized in place by a mounting bracket 32 assembled over the barrel and a typical gun barrel top sight 34 is provided. The entire system is lightweight and easily manipulated by a single operator even in relatively cramped quarters.

FIGS. 2*a*–2*d* depict details of typical reusable projectile or line carrying missile 24 which includes a shaft 40, a plurality of guiding fins 42 and a tail section 44. The dart or missile is further provided with a soft tip, such as a rubber tip member 46 and a line retaining device 48. As can be best seen in FIGS. 2*b* and 2*e*, the line retaining system may include a slotted member 50 which cooperates with a disk-shaped member 52 permanently attached to the aft end of the missile 24. The slotted member 50 is fastenable and releasable with respect to the member 52 as by a hook and loop-type removable attaching system such as those sold under various Velcro trademarks belonging to Velcro Industries. Thus, the line to be projected can be fastened through the slit 54 and the member 50 attached to the member 52 for line deployment.

Figure 3B:
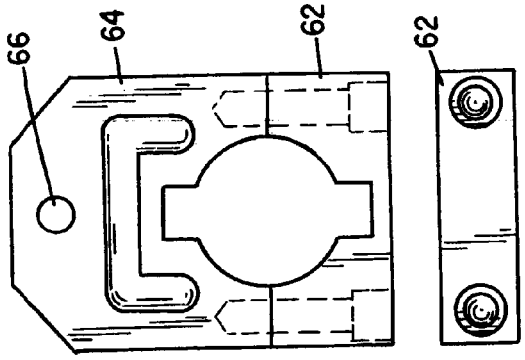
Figure 3A:
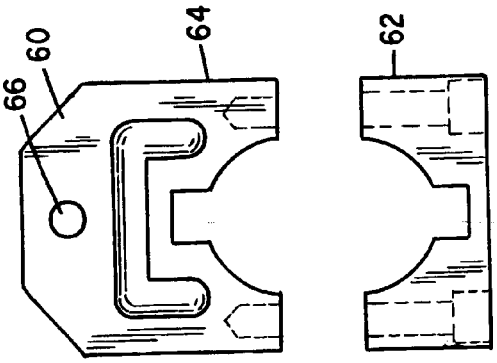
Figure 2D:
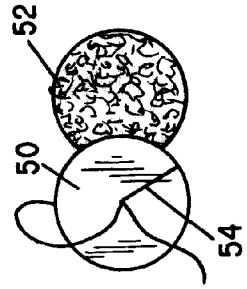
Figure 4A:
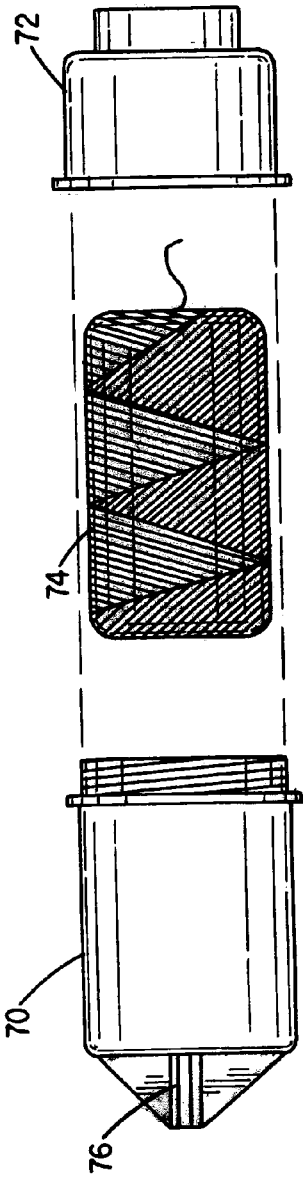
FIG. 4*a* is an exploded view of a filament dispensing device for use in the line projecting system of the invention.
Figure 4D:
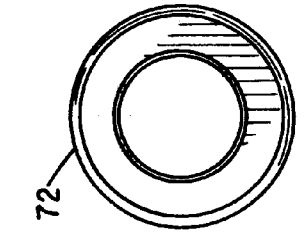
FIGS. 4*b*–4*d* represent end and side views of an assembled line dispensing device of FIG. 4*a*.
Figure 4B:
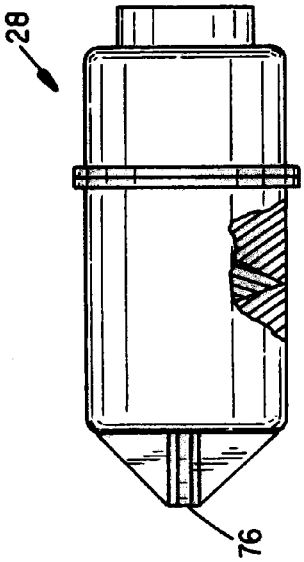
Figure 4C:
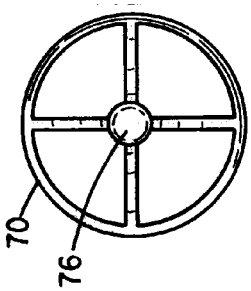
Figure 5A:
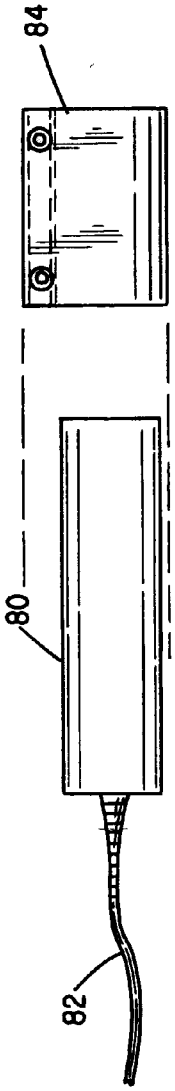
FIG. 5*a* is a view of a battery-operated laser sight device with bracket.
Figure 5B:
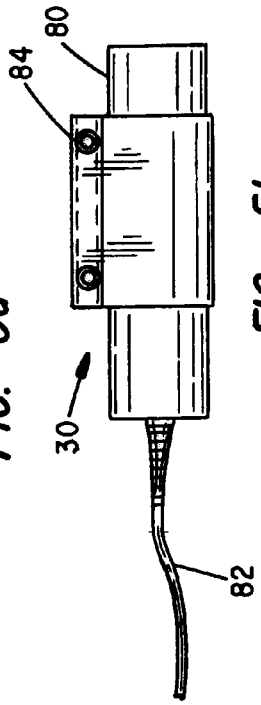
FIGS. 5*b* and 5*c* represent side and end views of the laser sight device of FIG. 5*a* assembled into the bracket.
Figure 5C:
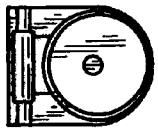

FIGS. 3*a*–3*c* depict enlarged detail views of a mounting bracket for a line payout spool which can be mounted on the barrel 22 as top and bottom segments 60 and 62 using a pair of counter-sunk screws (not shown) in socket 64 threaded in section 60. FIGS. 4*a*–4*d* depict one device for providing a source of line to be deployed in accordance with the line shooting tool of the invention and includes a rear housing member 70, a front housing member 72 and a captured spool of line at 74. The housing is shown assembled with parts cut away in FIG. 4*b* and rear and front views as shown in FIGS. 4*c* and 4*d*. A threaded recess 76 is provided in the rear housing section 70 to accept a threaded connector 94 (FIG. 6*b*) which is attached through an opening 66 and upper bracket member 60 to attach the spool housing to the tube or barrel of the tool of the invention. FIGS. 5*a*–5*c* depict a typical type battery-operated laser sighting device 80 with attached power supply cord 82 and mounting bracket 84, which mounts to the tube or barrel 22 in a well known fashion (see FIG. 6*b*).

Figure 6A:
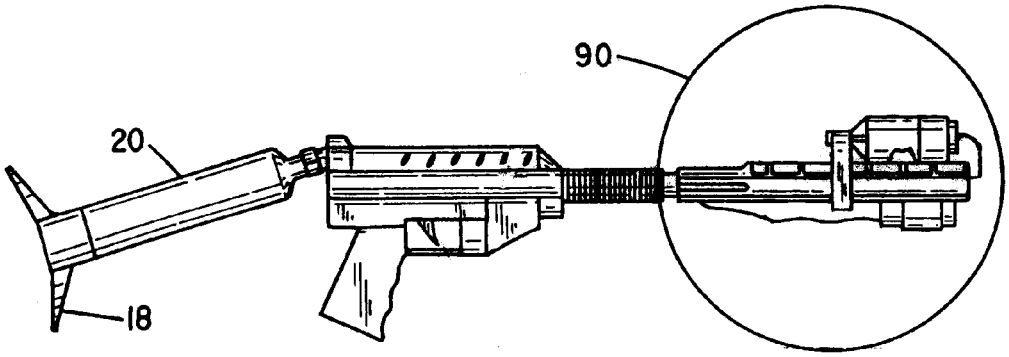
FIG. 6*a* represents another view of a line-shooting tool similar to FIG. 1 with detail circled in accordance with the invention.
Figure 6B:
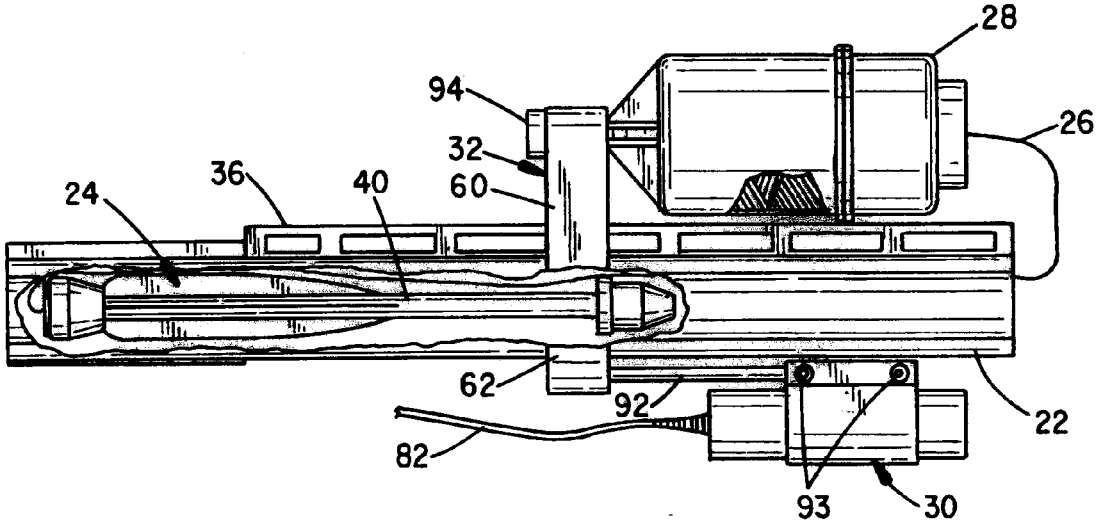
FIG. 6*b* represents a greatly enlarged muzzle fragment detail of the missile launching device as indicated in FIG. 6*a* with parts cut away to expose a loaded projectile.
Figure 6C:
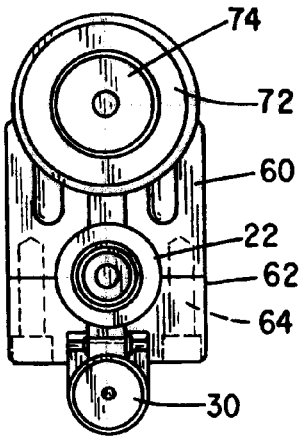
FIG. 6*c* is an enlarged end view of the muzzle fragment of FIG. 6*b*.

FIGS. 6*b* and 6*c* depict details of an enlarged fragment 90 of FIG. 6*a* of the line launching system of the invention. The FIG. 6*b* with parts cut away further depicts a member 92 for mounting the laser sight 30 using set screws 93 carried by lower bracket portion 62 and the mounting screw 94 which secures the line dispenser housing system 28 through upper bracket opening 66.

As an example of one use of the device, the line deploying tool of the invention may be used in a hand-held or shoulder-held configuration and with a projectile in place in a barrel, aimed using the battery-operated laser sight at a target area for pulling a line to be deployed. The projectile is then fired to the target and the lead line detached from the aft section of the projectile and, in turn, attached to the line or cable to be threaded back through the space through which the lead line had been fired. This is typically above an installed dropped ceiling or suspended ceiling frame in which the target may be the far wall of a large room. If a room is unusually large, shots can be made in two directions from a central location and the lines severed and joined as one long lead line. A multi-shot system with a plurality of available lines and projectiles would be advantageous here also.

This invention has been described herein in considerable detail in order to comply with the patent statutes and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. A hand-held pilot line deploying tool for use by an individual for projecting a pilot line across an undetermined span comprising:

(a) a launching tube having a chamber and an associated source of energy for launching a projectile from the tube and a muzzle end adapted to discharge a line deploying projectile;

(b) a projectile device to be launched from said launching tube for carrying one end of said line across said span;

(c) a source of lightweight pilot line connected to said launching tube and containing a supply of lightweight line to be connected to said projectile and payed out during a flight of said projectile;

(d) an axially-mounted sighting device connected to said launching tube for sighting said tube in on a selected remote target for said projectile; and (e) a device for triggering the launching of said projectile from said muzzle.

2. The apparatus of claim 1 wherein said source of energy for launching a connected projectile comprises a source of compressed gas.

3. The apparatus of claim 2 wherein said sighting device connected to said launching tube is a battery-operated laser sight.

4. The apparatus of claim 3 wherein said projectile is provided with a hook and loop system for releasably attaching one end of said line to said projectile.

5. The apparatus of claim 3 wherein said source of lightweight pilot line connected to said launching tube includes a housing and spool of line in said housing.

6. The apparatus of claim 5 wherein said source of lightweight pilot line and said laser sighting device are carried by a common bracket assembled on said launching tube.

7. The apparatus of claim 2 wherein said projectile is provided with a hook and loop system for releasably attaching one end of said line to said projectile.

8. The apparatus of claim 2 wherein said projectile is a reusable soft-nosed dart.

9. The apparatus of claim 1 wherein said projectile is a reusable soft-nosed dart.

10. The apparatus of claim 1 wherein said projectile is provided with a hook and loop system for releasably attaching one end of said line to said projectile.

11. The apparatus of claim 1 wherein said sighting device connected to said launching tube is a battery-operated laser sight.

12. The apparatus of claim 1 wherein said projectile is muzzle loaded.

13. The apparatus of claim 1 wherein said source of lightweight pilot line connected to said launching tube includes a housing and spool of line in said housing.

14. A hand-held line deploying tool for deploying a pilot line for use in installing an electrical conductor of interest across a span of limited access such as a span above a dropped ceiling, said tool comprising:

(a) a gas-operated hollow launching tube having a chamber with a muzzle for containing and launching a muzzle loaded benign projectile;

(b) a source of pilot line mounted to said launching tube containing a supply of line to be releasibly connected to a projectile and payed out during the flight of an associated projectile;

(c) a projectile adapted to be launched from the muzzle of said launching tube and to carry one end of said line across said span;

(d) an axially mounted, light projecting sighting device connecting to said launching tube for sighting said launching tube on a remote spot to which said projectile is to be launched;

(e) a source of propelling gas connected to said hollow launching tube; and (f) a device for triggering the launching of said projectile from said muzzle.

15. The apparatus of claim 14 wherein said source of line connected to said launching tube includes a housing and spool of line in said housing.

16. The apparatus of claim 15 wherein said source of pilot line and said sighting device are carried by a common bracket assembled on said launching tube.

17. The apparatus of claim 14 wherein said projectile is provided with a hook and loop system for releasibly attaching the free end of said line to said projectile.

* * * * *